United States Patent [19]

Tsuboi

[11] Patent Number: 4,957,417

[45] Date of Patent: Sep. 18, 1990

[54] VERTICAL OILLESS SCREW VACUUM PUMP

[75] Inventor: Noboru Tsuboi, Kakogawa, Japan

[73] Assignee: Kabushiki Kaisha Kobe Seiko Sho, Kobe, Japan

[21] Appl. No.: 379,936

[22] Filed: Jul. 14, 1989

[51] Int. Cl.[5] ..... F04B 35/04; F01C 1/24

[52] U.S. Cl. ..... 417/423.13; 418/201.1

[58] Field of Search ..... 418/201 R; 417/424.2, 417/423.1, 423.6, 423.7, 423.8, 423.12, 423.13; 184/6.16

[56] References Cited

FOREIGN PATENT DOCUMENTS

| | | | |
|---|---|---|---|
| 323834 | 6/1989 | European Pat. Off. | 418/201 R |
| 259971 | 12/1985 | Japan | 418/201 R |
| 8303641 | 9/1983 | PCT Int'l Appl. | 418/201 R |

*Primary Examiner*—Leonard E. Smith
*Assistant Examiner*—John A. Savio, III
*Attorney, Agent, or Firm*—Oblon, Spivak, McClelland, Maier & Neustadt

[57] ABSTRACT

A vertical oilless screw vacuum pump for effective use in industrial processes to which air containing oil is detrimental, such as vacuum food packaging processes and semiconductor device manufacturing processes. The vertical oilless screw vacuum pump includes a pump unit having a pump casing provided with a suction port in the upper portion and a discharge port in the lower portion thereof, and a set of meshed male and female oilless screw rotors disposed within the pump casing A, also high-frequency motor is disposed under the pump unit and has a motor casing joined to the lower end of the pump casing. The output shaft of the motor is coupled directly with one of the rotor shafts of the oilless screw rotors to drive the oilless screw rotors directly without using any gear train. Bearings supporting the upper ends of the rotor shafts are lubricated by a grease having a vapor pressure below a desired ultimate vacuum to be achieved by the vertical oilless screw vacuum pump. The motor casing is used also as an oil reservoir for containing a lubricating oil for lubricating bearings supporting the lower ends of the rotor shafts. The use of the grease for lubricating the bearings disposed near the suction ports avoids the dispersion of oil into a vacuum. The direct coupling of the rotor shaft and the output shaft of the motor, and the use of the motor casing as an oil reservoir enables the vertical oilless screw vacuum pump to be constructed in a compact construction.

2 Claims, 5 Drawing Sheets

VERTICAL OILLESS SCREW VACUUM PUMP

BACKGROUND OF THE INVENTION

1. Field of the Invention

The present invention relates to a screw vacuum pump for use in combination with vacuum apparatus for creating a vacuum in industrial processes including vacuum packaging processes and semiconductor device manufacturing processes and, more particularly, to a vertical oilless screw vacuum pump for such purposes.

2. Description of the Prior Art

A known oilless screw vacuum pump shown in FIG. 7 has a set of meshing male and female screw rotors (hereinafter referred to simply as "rotors") 3 disposed within a rotor chamber formed in a casing 4 and opening at one end into a suction port 5 and at the other end into a discharge port 6. The rotors 3 are supported for rotation with a small gap therebetween each at the opposite ends thereof in bearings 1 and 2. Timing gears 7 are attached to the respective ends of the shafts of the rotors 3 on the side of the suction port 5, respectively, and the timing gears 7 are meshed. One of the timing gears 7 is in mesh with a driving gear 9 attached to the output shaft of a motor 14.

The rotation of the output shaft 8 is transmitted to the timing gear 7 at a speed increasing ratio to rotate the rotors 3. The rotate 3 rotates synchronously respectively in opposite directions to suck in a gas, compress the gas and discharge the compressed gas through the discharge port 6.

Generally, ultimate vacuum is the most the most significant value among those indicating the performance of the vacuum pump. With the screw vacuum pump shown in FIG. 7, ultimate vacuum is a minimum achievable vacuum in the rotor chamber when the screw vacuum pump is operated with the opening of the rotor chamber on the side of the suction port 5 closed.

In the foregoing known screw vacuum pump, the gears and the bearings are lubricated with a lubricating oil and hence the lubricating oil mixes with air. On the other hand, a vacuum state prevails in the vicinity of the suction port 5, while an atmospheric state prevails in the vicinity of the discharge port 6 and the gear chamber 12. Accordingly, air leaks from shaft seal parts 13 near the suction port 5 as indicated by an arrow a expressed by a broken line and reverse flow of air, as indicated by an arrow b expressed by a broken line, from the discharge port 6 toward the suction port 5 through the gaps between the teeth of rotors 3 increases to lower the ultimate vacuum. The volume of air at atmospheric pressure (760 torr) leaked into the rotor chamber 3 in a vacuum state of a vacuum in the range of up to $10^{-3}$ torr expands to a volume $10^5$ to $10^6$ times as much, and hence the rotors 3 are unable to function properly and the rotor chamber cannot be evacuated to a sufficiently high ultimate vacuum.

Furthermore, since the rotation of the motor 14 is transmitted at a speed increasing ratio through the gears 9 and 7 to the rotors 3, the screw vacuum pump must be provided with a comparatively large gear chamber 12 for containing the gears 7 and 9, which increases the size of the screw vacuum pump.

SUMMARY OF THE INVENTION

Accordingly, it is an object of the present invention to provide a screw vacuum pump capable of preventing the reverse flow of air and having a compact construction.

In one aspect of the present invention, a vertical oilless screw vacuum pump comprises: a pump unit comprising a pump casing, and a set of meshed male and female rotors rotatably supported in bearings in a rotor chamber formed in the casing and having an opening opened into a suction port and an opening opened into a discharge port; and a high-frequency motor having a motor casing and operatively connected to the pump unit, wherein the pump unit is set in a vertical position with the discharge port on the lower side, the high-frequency motor is disposed under the pump unit with the output shaft thereof coupled directly with the rotor shaft of one of the rotors on the side of the discharge port, and the motor casing is used also as an oil reservoir.

In another aspect of the present invention, the bearings supporting the rotors on the side of the suction port are lubricated by a grease having a vapor pressure lower than a desired ultimate vacuum to prevent air contained in a lubricating oil from entering the rotor chamber.

Thus, leakage of air through the shaft seal part near the suction port is prevented and thereby the vertical oilless screw vacuum pump of the present invention is able to create a higher ultimate vacuum.

Furthermore, the present invention omits the speed increasing gear train, which is necessary in the conventional screw vacuum pump, uses the lubricating oil effectively for cooling the motor and uses the motor casing also as an oil reservoir. Accordingly, the vertical oilless screw vacuum pump of the present invention can be constructed in a compact construction and requires a small space for installation.

BRIEF DESCRIPTION OF THE DRAWINGS

The above and other objects, features and advantages of the present invention will become more apparent from the following description taken in conjunction with the accompanying drawings, in which.

Figure 1:
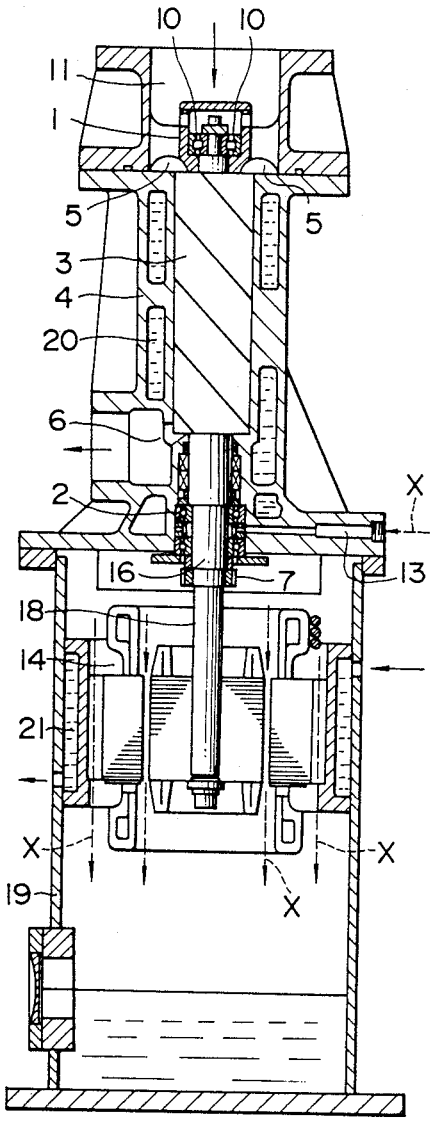
FIG. 1 is a longitudinal sectional view of a vertical oilless screw vacuum pump in a first embodiment according to the present invention.
Figure 2:
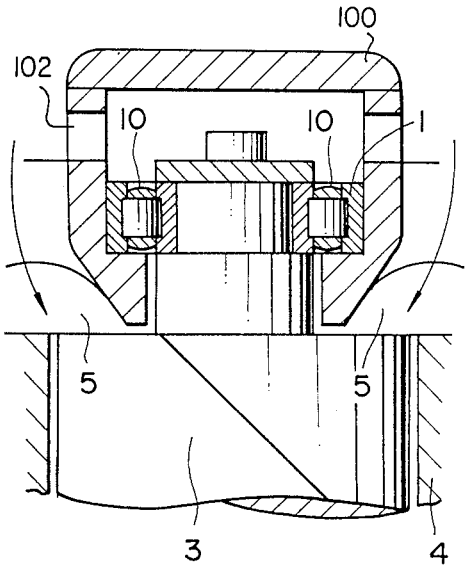
FIG. 2 is an enlarged fragmentary sectional view of a bearing provided on the suction side of the vertical oilless screw vacuum pump of FIG. 1.

First Embodiment (FIGS. 1 and 2)

A set of meshed male and female rotors 3 are disposed in a rotor chamber formed in a pump casing 4 and are supported rotatably on the pump casing 4 in bearings 1 and 2 at the opposite ends of the rotor shaft 16 thereof.

The rotor chamber opens at one end into a suction port 6 and opens at the other end into a discharge port 6. Timing gears 7 are attached to the ends of the rotor shafts 16 on the side of the discharge port 6 in mesh with each other. One of the rotor shafts 16 is coupled directly with the output shaft 18 of a flanged high-frequency motor 17 driven by high-frequency power.

The direct coupling of the rotor shaft 16 and the output shaft 18 of the high-frequency motor 17 enables the omission of a speed increasing gear train and the construction of the vertical oilless screw vacuum pump in a small size as compared with the screw vacuum pump having a speed increasing gear train. Since the driving arrangement, which allows air to leak into the casing 4, is provided on the side of the discharge port 6, the that is, the bearings 1 are supported in bearing cases 100 having apertures 102, so that air in the suction path can impinge on the bearings and cool the same bearings 1 on the side of the suction port 5 are sealed off perfectly to prevent the leakage of the atmosphere. A grease 10 having a vapor pressure below a desired ultimate vacuum, for example, $10^{-3}$ torr, is sealed in the bearings 1 on the side of the suction port 5, and the bearings 1 are disposed in a suction path 11 to cool the bearings 1 and the grease 10 so that the degradation of the grease 10 is prevented. The grease 10 also has a property of maintaining a constant shape for a long time in a fixed place; that is, no liquid lubricating oil is used because liquid lubricating oils flow continuously, must be supplied from an external source and the oil supplied from the external source is often accompanied by air. The grease 10 is changed by opening a cover, not shown, attached to the casing 4 to cover the bearings 1 while the vertical oilless screw vacuum pump is stopped.

The bearings 2 on the side of the discharge port 6 and the timing gears 7 are lubricated by a lubricating oil injected into the casing 4 through a lubricating hole 13. Although the lubricating oil, in most cases, contains air, the flow of air contained in the lubricating oil through the bearings 2 into the motor casing 19 is not any problem, because the atmospheric pressure prevails in the vicinity of the discharge port 6 and the interior of the motor casing 19.

Since the vertical oilless screw vacuum pump is set in a vertical position, the motor casing 19 can be used also as an oil reservoir. The lubricating oil supplied to the bearings 2 flows through the gap between the rotor and stator of the motor 17 and through longitudinal through holes formed in the stator into the bottom of the motor casing 19 cooling the motor 17 as indicated by arrows X expressed by broken lines. The omission of gears for operatively connecting the rotor shafts 16 and the output shaft 18 of the motor 17 and the use of the motor casing 19 as an oil reservoir enables the construction of the vertical oilless screw vacuum pump in a further reduced size.

In FIG. 1, indicated at 20 and 21 are water jackets respectively for cooling the pump unit and the motor 17.

Figure 3:
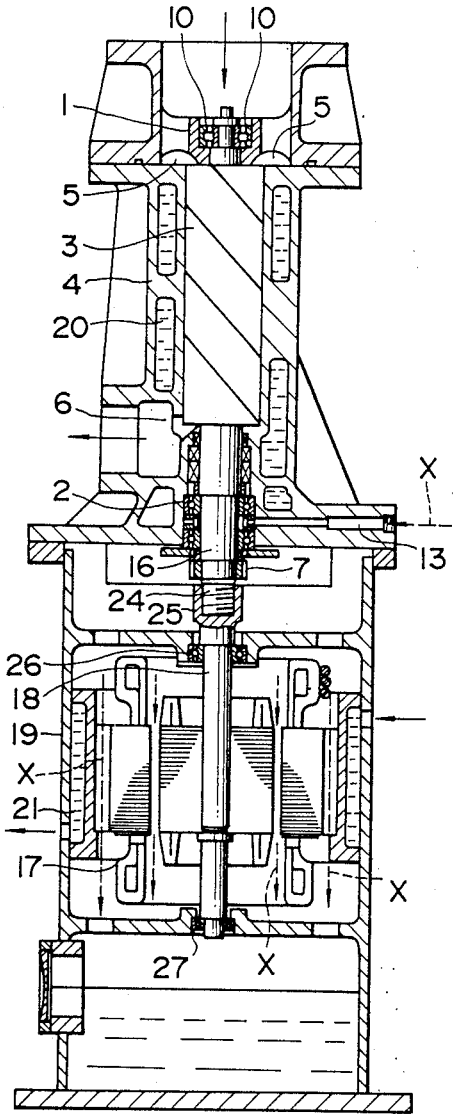
FIG. 3 is a longitudinal sectional view of a vertical oilless screw vacuum pump in a second embodiment according to the present invention.

Second Embodiment (FIG. 3)

A vertical oilless screw vacuum pump in a second embodiment is substantially the same in construction as the vertical oilless screw vacuum pump in the first embodiment, except that a coupling mechanism for coupling a rotor shaft 16 and the output shaft 18 of a motor and a supporting mechanism for supporting the output shaft 18 of the motor 17 employed in the vertical oilless screw vacuum pump in the second embodiment are different from those employed in the vertical oilless screw vacuum pump in the first embodiment, and hence parts of the vertical oilless screw vacuum pump in the second embodiment like or corresponding to those of the vertical oilless screw vacuum pump in the first embodiment are denoted by the same reference characters and the description thereof will be omitted to avoid duplication.

Referring to FIG. 3, one of the rotor shafts 16 and the output shaft 18 of the motor 17 are connected by engaging spiral external splines 24 cut in one of the rotor shafts 16 and internal splines 25 cut in the output shaft 18 of the motor 17 to transmit the rotative force of the output shaft 18 to the rotor shaft 16 and to enable the motor 17 to be moved axially relative to the rotor shaft 16 in separating the motor 17 from the screw vacuum pump unit, which facilitates the manufacture and maintenance of the vertical oilless screw vacuum pump. The output shaft 18 of the motor 17 is supported for rotation on the motor casing 19 in bearings 26 and 27.

Figure 4:
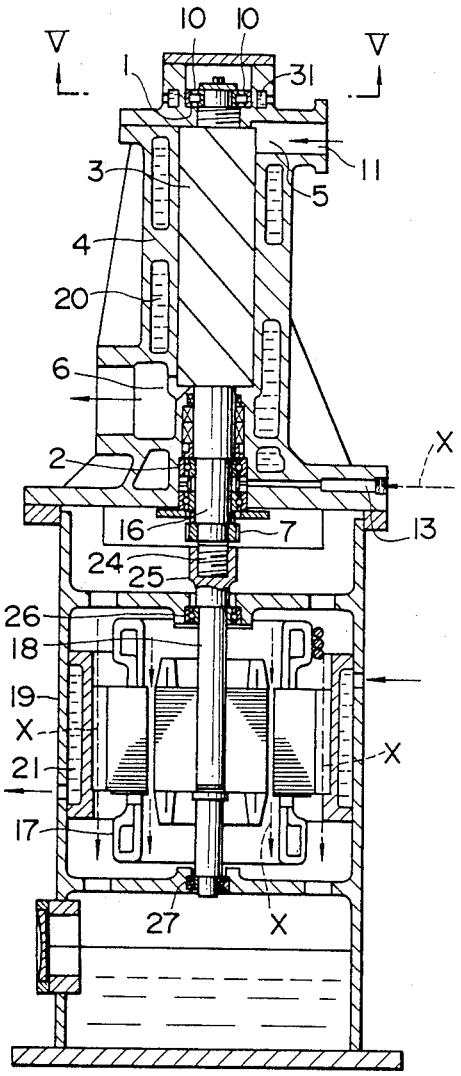
FIG. 4 is a longitudinal sectional view of a vertical oilless screw vacuum pump in a third embodiment according to the present invention.
Figure 5:
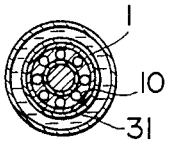
FIG. 5 is a sectional view taken on line V—V in FIG. 4.

Third Embodiment (FIGS. 4 and 5)

A vertical oilless screw vacuum pump in a third embodiment is substantially the same in construction as the vertical oilless screw vacuum pump in the second embodiment, except that the vertical oilless screw vacuum pump in the third embodiment has bearings 1 supporting the upper ends of rotor shafts are disposed apart from a suction port 5 and outside a suction path 11, and the bearings 1 are water-cooled.

Referring to FIGS. 4 and 5, the suction port 5 and the suction path 11 are formed in the upper end, as viewed in FIG. 4, of a casing 4, and the bearings 1 are provided in a chamber partitioned from the interior of the casing 4. The bearings 1 are surrounded by a cooling jacket 31 for water-cooling the bearings 1 and grease 10 sealed in the bearings 1. The grease 10 is changed by opening a cover, not shown, attached to the casing 4 to cover the bearings 1 while the vertical oilless screw vacuum pump is stopped.

Figure 6:
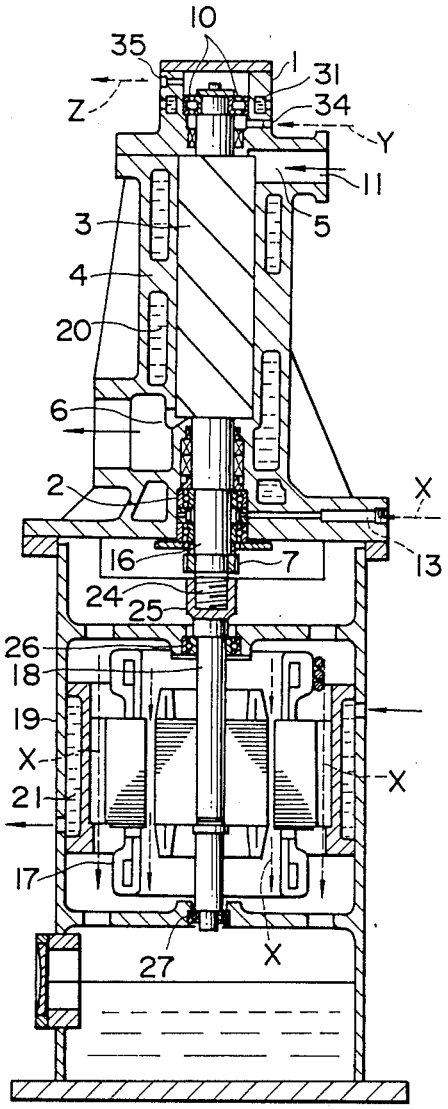
FIG. 6 is a longitudinal sectional view of a vertical oilless screw vacuum pump in a fourth embodiment according to the present invention.
Figure 7:
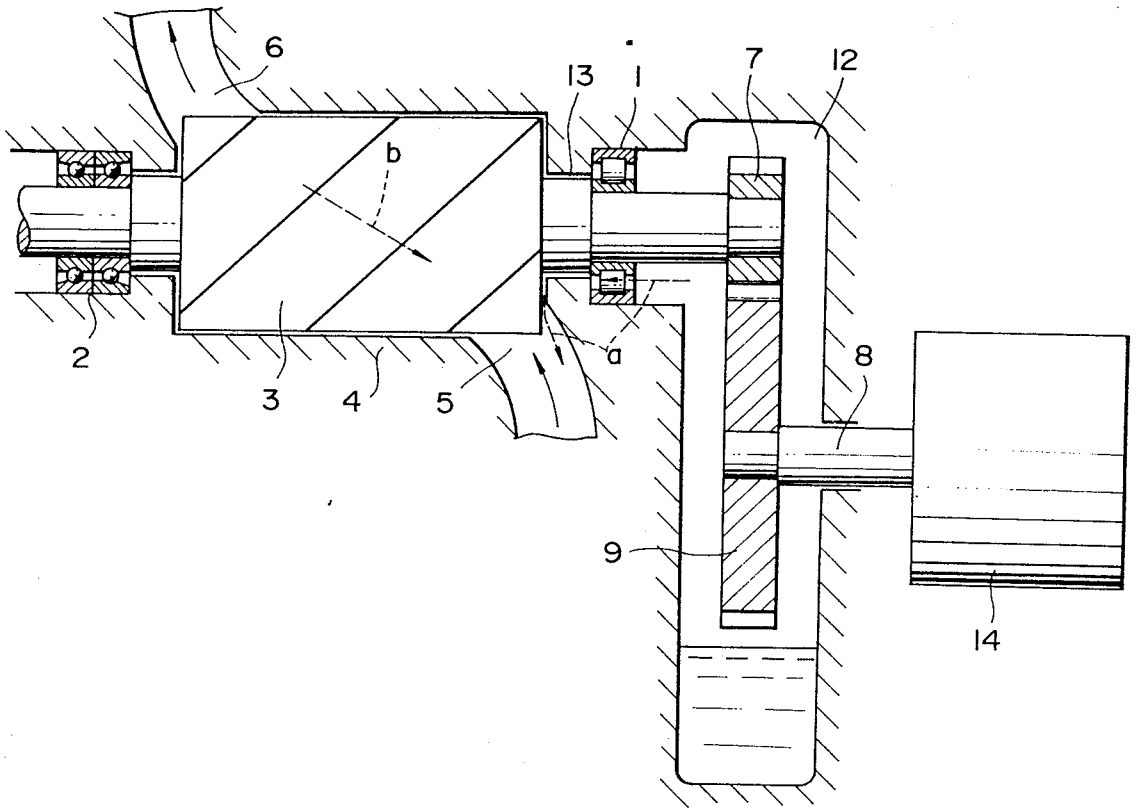
FIG. 7 PRIOR ART
FIG. 7 is a longitudinal sectional view of a conventional oilless screw vacuum pump. cl DETAILED DESCRIPTION OF THE PREFERRED EMBODIMENTS

Fourth Embodiment (FIG. 6)

A vertical oilless screw vacuum pump in a fourth embodiment is substantially the same in construction as the vertical oilless screw vacuum pump in the third embodiment, except that the vertical oilless screw vacuum pump in the fourth embodiment is provided with a greasing hole 34 and a grease ejecting hole 35 to supply new grease to the bearings 1 as indicated by an arrow Y and to eject old grease from the bearing house containing the bearings 1 as indicated by an arrow Z.

Although the invention has been described in its specific embodiments with a certain degree of particularity, various changes and variations are possible therein and it is therefore to be understood that the present invention may be practiced otherwise than specifically described herein without departing from the scope and spirit thereof.

What is claimed is:

1. A vertical oilless screw vacuum pump comprising: a pump unit comprising:

(a) a pump casing provided with a suction port in the upper portion thereof and a discharge port in the lower portion thereof, (b) a set of vertically extending meshed male and female oilless screw rotors disposed within a rotor chamber formed in the casing and having rotor shafts supported for rotation at opposite ends thereof in roller bearings on the casing, and (c) a pair of timing gears attached to lower ends of the rotor shafts of said male and female oilless screw rotors; and a high frequency motor driven by high-frequency power, disposed under the pump unit and having a motor casing joined to a lower end of said pump casing, said high-frequency motor having a vertically extending output shaft;

wherein an upper end of the said output shaft of said high frequency motor is coupled directly with the lower end of one of said rotor shafts to drive the male and female oilless screw rotors directly, and wherein the motor casing contains a supply of oil such that said motor casing comprises an oil reservoir, wherein the bearings supporting upper ends of the roller shafts are held in bearing casings having apertures, including a grease lubricating the bearings supporting upper ends of the rotor shafts, said grease having a vapor pressure below a desired ultimate vacuum to be achieved by the vertical oilless screw vacuum pump, wherein air flow can flow through said apertures such that the bearing supporting the upper ends of said rotor shafts are impinged by the air flow and are disposed in a suction flow path, and so are cooled.

2. A vertical oilless screw vacumm pump according to claim 1 including means for lubricating the bearings supporting the lower ends of the rotor shafts with oil from said oil reservoir.

* * * * *